US005908571A

United States Patent [19]

Scott

[11] Patent Number: 5,908,571

[45] Date of Patent: Jun. 1, 1999

[54] RADIANT ELECTRIC HEATER ARRANGEMENT

[75] Inventor: Richard Charles Scott, Stourport-on-Severn, United Kingdom

[73] Assignee: Ceramaspeed Limited, United Kingdom

[21] Appl. No.: 08/833,882

[22] Filed: Apr. 10, 1997

[30] Foreign Application Priority Data

Apr. 26, 1996 [GB] United Kingdom ..... 9608669

[51] Int. Cl.[6] ..... H05B 3/68; H05B 3/02; H05B 1/02

[52] U.S. Cl. ..... 219/457.1; 219/448; 219/486; 219/492

[58] Field of Search ..... 219/445, 446, 219/448, 451, 452, 453, 464, 486, 489, 490, 492

[56] References Cited

U.S. PATENT DOCUMENTS

| | | | |
|---|---|---|---|
| 4,740,664 | 4/1988 | Payne et al. . | |
| 4,786,799 | 11/1988 | Well, Jr. et al. . | |
| 5,171,973 | 12/1992 | Higgins | 219/464 |

FOREIGN PATENT DOCUMENTS

| | | |
|---|---|---|
| 0442139 | 8/1991 | European Pat. Off. . |
| 610471 | 2/1935 | Germany . |
| 4028954 | 3/1992 | Germany . |
| 4224666 | 1/1994 | Germany . |
| 786121 | 11/1957 | United Kingdom . |
| 1235683 | 7/1971 | United Kingdom . |
| 1529862 | 9/1978 | United Kingdom . |
| WO8603929 | 7/1986 | WIPO . |

OTHER PUBLICATIONS

European Search Report, Jul. 30, 1998.

*Primary Examiner*—Teresa Walberg
*Assistant Examiner*—Sam Paik
*Attorney, Agent, or Firm*—Ira S. Dorman

[57] ABSTRACT

A radiant electric heater arrangement is provided for connection to a dual voltage supply which provides a first alternating current supply voltage and a second alternating current supply voltage higher than the first. The arrangement includes a heater having at least one heating element and a manually operable multiple discrete position switch means for manually selecting in sequence a predetermined number of discrete different power settings for the at least one heating element from the voltage supply. The arrangement further includes control means co-operating between the switch means and the supply whereby in each position of a first sequential series of discrete positions of the switch means the at least one heating element is selectively energisable from the first supply voltage in such a way that at least one selected proportion of half cycles in a predetermined number of half cycles of the first supply voltage is or are arranged for application to the at least one heating element, and further whereby in each position of a second sequential series of discrete positions of the switch means, following the first sequential series, the at least one heating element is selectively energisable from the second supply voltage in such a way that at least one selected proportion of half cycles in a predetermined number of half cycles of the second supply voltage is arranged for application to the at least one heating element. In this way a stepwise increase in power output from the heater is obtainable in operation from one position of the switch means to the next through the first and second sequential series of switch positions.

20 Claims, 5 Drawing Sheets

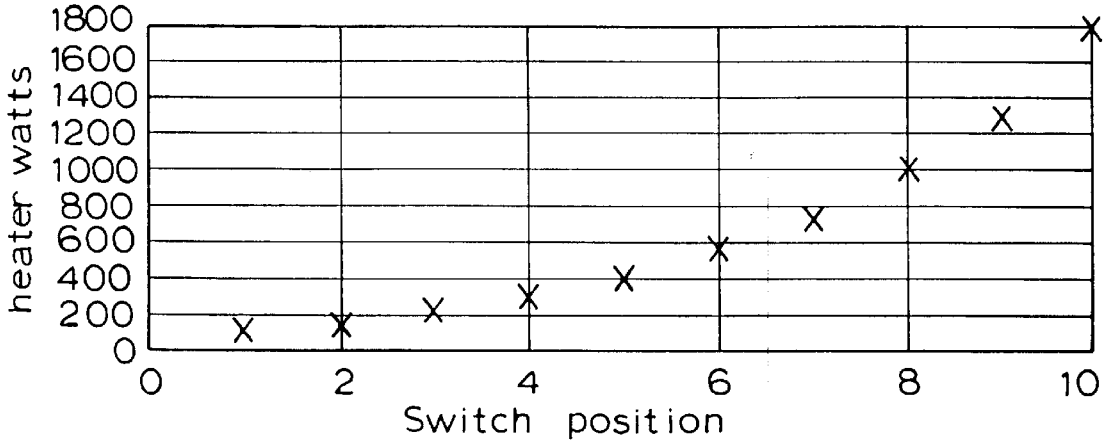
FIG 4
FIG 5A
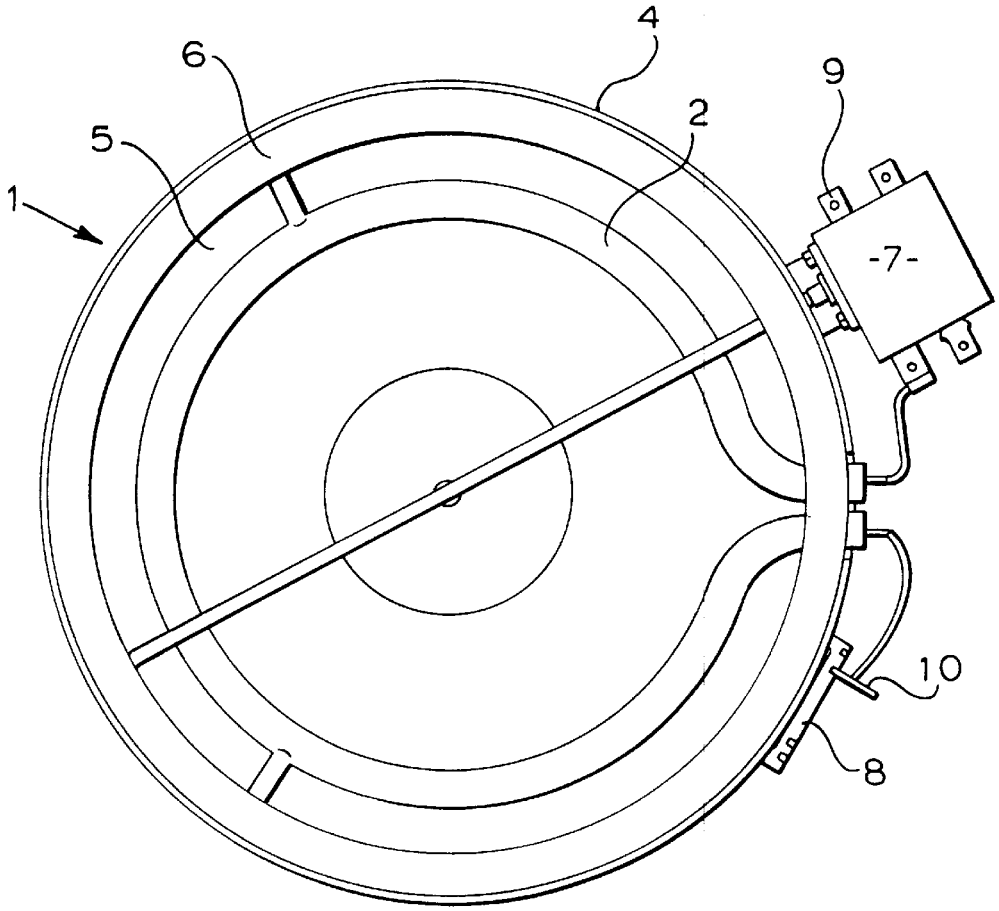

RADIANT ELECTRIC HEATER ARRANGEMENT

This invention relates to an arrangement of a radiant electric heater and a multiple position switch means, which arrangement is for connection to an alternating current power supply system providing two different power supply voltages.

BACKGROUND TO THE INVENTION

Radiant electric heaters are well known in which one or more heating elements are supported, for example, on or above a layer of thermal insulation material in a metal dish. Heaters of this kind generally incorporate one or more heating elements selected, for example, from: coiled bare resistance wire; metal ribbon, particularly of corrugated form; infra-red lamp(s).

Such heaters are typically incorporated in cooking, or other heating, appliances having a flat glass-ceramic cooking/heating surface.

Different power levels have been provided by including two or more heating elements in the heater, with a switch arranged to couple the elements into different series and/or parallel configurations in different switch positions.

In designing such heaters various different and possibly conflicting requirements must be accommodated. The resistances of the different heating elements must be chosen so that differing combinations of the elements produce power levels which together form an appropriately distributed sequence between zero and full power. In particular it has been found generally desirable to include a very low power level, of the order of 5 percent of full power. Where possible the intensity of visible light radiation produced by the energised elements at each power setting should be indicative of the power level at that setting; in addition it may be desirable that one or more elements should be energised sufficiently to produce some visible radiation for as many power settings as possible, to provide assurance to the user that the heater is functioning. This is particularly the case for any infra-red lamp heating element that may be included in the heater; the presence of an infra-red lamp element in an appliance typically results in a premium price, so the user is likely to expect that element to be visible in use.

DESCRIPTION OF PRIOR ART

U.S. Pat. No. 5,171,973 describes a radiant electric heater arrangement which utilises series/parallel switching of at least two heating elements and a diode. When a heating element comprising an infra-red lamp is incorporated, this has usually to be operated permanently connected in series with a further heating element which serves as a ballast resistor to damp the inrush current of the lamp. In such an arrangement, therefore, three heating elements are present in the heater. When used with a multiple position switch and a dual voltage supply (for example 120 V/240 V), as many as ten heat settings can be obtained with a good spread of heating power over the range of settings. The available range includes a very satisfactory low power level of the order of 5 percent of full power.

This prior art arrangement does, however, suffer from disadvantages. When used with an infra-red lamp heating element and two coiled wire heating elements it is found that the illumination of the lamp is not visible against the radiance of the other heating elements in some lower power positions of the switch. Furthermore no change in brightness of the lamp may be experienced between some adjacent power positions of the switch.

OBJECT OF THE INVENTION

It is an object of the present invention to overcome or minimise these disadvantages by providing a radiant electric heater arrangement which is operated from a dual voltage supply and may be used with a single heating element (or single combination of two heating elements in the case of an infra-red lamp where a permanently series-connected ballast element is required) in association with a multiple position (for example 10 position) switch to provide an excellent distribution of heating powers and a stepwise visible gradation of element brightness across the range of switch positions.

SUMMARY OF THE INVENTION

The present invention provides a radiant electric heater arrangement for connection to a dual voltage supply which provides a first alternating current supply voltage and a second alternating current supply voltage higher than the first, the arrangement comprising:

a heater having at least one heating element;

a manually operable multiple discrete position switch means for manually selecting in sequence a predetermined number of discrete different power settings for the at least one heating element from the voltage supply;

control means co-operating between the switch means and the supply whereby in each position of a first sequential series of discrete positions of the switch means the at least one heating element is selectively energisable from the first supply voltage in such a way that at least one selected proportion of half cycles in a predetermined number of half cycles of the first supply voltage is or are arranged for application to the at least one heating element;

and further whereby in each position of a second sequential series of discrete positions of the switch means, following the first sequential series, the at least one heating element is selectively energisable from the second supply voltage in such a way that at least one selected proportion of half cycles in a predetermined number of half cycles of the second supply voltage is arranged for application to the at least one heating element; the arrangement being such that a stepwise increase in power output from the heater is obtainable in operation from one position of the switch means to the next through the first and second sequential series of switch positions.

The at least one heating element may comprise one or more elements selected from: coiled bare resistance wire; metal ribbon, particularly of corrugated form; infra-red lamp(s), particularly comprising a tungsten filament inside a quartz or fused silica envelope containing a halogenated atmosphere; molybdenum disilicide wire or strip.

Where a heating element comprising an infra-red lamp or a molybdenum disilicide wire or strip is employed, this may for some applications require the provision in the heater of a second heating element, suitably of coiled bare resistance wire or metal ribbon form, permanently connected in series with the infra-red lamp or molybdenum disilicide wire or strip. Such second heating element serves as a ballast resistor to damp inrush current in the lamp or molybdenum disilicide heating element.

The dual voltage supply may comprise an alternating current supply having at least two phases and in which the first alternating current supply voltage is obtained by connecting to a line for one supply phase and a neutral line and the second alternating current supply voltage is obtained by connecting to lines for two supply phases. For example, in the USA the two-phase supply in that country may be used to provide a first supply voltage of 120 volts and a second supply voltage of 240 volts. In some European countries, such as Germany, where a supply voltage of two phases and a neutral line is available, a first supply voltage of, for example, 230 volts and a second supply voltage of, for example, 400 volts may be provided.

In one embodiment of the invention, in the first sequential series of discrete positions of the switch means the at least one heating element is selectively energisable from the first supply voltage in such a way that from one switch position to the next a selectively increased proportion of half cycles in a predetermined number of half cycles of the first supply voltage is arranged for application to the at least one heating element and in the second sequential series of discrete positions of the switch means, following the first sequential series, the at least one heating element is selectively energisable from the second supply voltage in such a way that from one switch position to the next in the second sequential series a selectively increased proportion of half cycles in a predetermined number of half cycles of the second supply voltage is arranged for application to the at least one heating element.

In an example of such an embodiment, a switch means having ten positions is provided; a first alternating current A supply voltage of substantially 120 volts and a second alternating current supply voltage of substantially 240 volts is arranged and in a first sequential series of six discrete positions the at least one heating element is selectively energisable from the first supply voltage such that:

a) in the first position, one half cycle in every seven half cycles of the first supply voltage is arranged for application to the at least one heating element;

b) in the second position, one half cycle in every five half cycles of the first supply voltage is arranged for application to the at least one heating element;

c) in the third position, one half cycle in every three half cycles of the first supply voltage is arranged for application to the at least one heating element;

d) in the fourth position, two half cycles in every four half cycles of the first supply voltage are arranged for application to the at least one heating element;

e) in the fifth position, two half cycles in every three half cycles of the first supply voltage are arranged for application to the at least one heating element;

f) in the sixth position, the first supply voltage in full and complete cyclic form is arranged for application to the at least one heating element;

and in a second sequential series of four discrete positions, following on from the first series and comprising positions seven to ten of the switch means, the at least one heating element is selectively energisable from the second supply voltage such that:

i) in the seventh position, one half cycle in every three half cycles of the second supply voltage is arranged for application to the at least one heating element;

ii) in the eighth position, two half cycles in every four half cycles of the second supply voltage are arranged for application to the at least one heating element;

iii) in the ninth position, two half cycles in every three half cycles of the second supply voltage are arranged for application to the at least one heating element;

iv) in the tenth position, the second supply voltage in full and complete cyclic form is arranged for application to the at least one heating element.

The heater arrangement of the invention may be embodied such that in one or more positions of the switch means each sequence of a predetermined number of half cycles of the first or second supply voltage is separated into first and second selected proportions, the second proportion being different from the first proportion, with the first and second proportions following each other cyclically in sequence and each in predetermined ratio of the total number of half cycles in each sequence. With this arrangement, only the first or the second selected proportion of half cycles in each sequence may be such as to result in application of the supply voltage to the at least one heating element.

In an example of such an embodiment, a switch means having ten positions is provided; a first alternating current supply voltage of substantially 230 volts and a second alternating current supply voltage of substantially 400 volts is arranged and in a first sequential series of seven discrete switch positions the at least one heating element is selectively energisable from the first supply voltage such that:

a) in the first position, one half cycle in every three half cycles of the first supply voltage is arranged for application cyclically to the at least one heating element for about 40 percent of a sequence of a predetermined number of half cycles, substantially no supply voltage being arranged to be applied to the at least one heating element during the remaining about 60 percent of each sequence;

b) in the second position, one half cycle in every three half cycles of the first supply voltage is arranged for application cyclically to the at least one heating element for about 55 percent of a sequence of a predetermined number of half cycles, substantially no supply voltage being arranged to be applied to the at least one heating element during the remaining about 45 percent of each sequence;

c) in the third position, one half cycle in every three half cycles of the first supply voltage is arranged for application cyclically to the at least one heating element for about 75 percent of a sequence of a predetermined number of half cycles, substantially no supply voltage being arranged to be applied to the at least one heating element during the remaining about 25 percent of each sequence;

d) in the fourth position, one half cycle in every three half cycles of the first supply voltage is arranged for continuous application to the at least one heating element;

e) in the fifth position, two half cycles in every three half cycles of the first supply voltage are arranged for application cyclically to the at least one heating element for about 40 percent of a sequence of a predetermined number of half cycles and one half cycle in every three half cycles of the first supply voltage is arranged for application to the at least one heating element during the remaining about 60 percent of each sequence;

f) in the sixth position, two half cycles in every three half cycles of the first supply voltage are arranged for continuous application to the at least one heating element;

g) in the seventh position, the first supply voltage in full and complete cyclic form is arranged for application to the at least one heating element:

and in a second sequential series of three discrete positions, following on from the first series and comprising positions eight to ten of the switch means, the at least one heating element is selectively energisable from the second supply voltage such that:

i) in the eighth position, two half cycles in every three half cycles of the second supply voltage are arranged for application cyclically to the at least one heating element for about 40 percent of a sequence of a predetermined number of half cycles and one half cycle in every three half cycles of the second supply voltage is arranged for application to the at least one heating element during the remaining about 60 percent of each sequence;

ii) in the ninth position, two half cycles in every three half cycles of the second supply voltage are arranged for continuous application to the at least one heating element;

iii) in the tenth position, the second supply voltage in full and complete cyclic form is arranged for application to the at least one heating element.

Preferably the at least one heating element comprises an infra-red lamp, optionally connected in series with a further heating element of coiled bare resistance wire or metal ribbon form. Such infra-red lamp may particularly comprise a tungsten filament inside a quartz or fused silica envelope containing a halogenated atmosphere.

The control means may comprise a microprocessor-based control system, preferably in association with a triac switching element.

By means of the invention, sequential selection of the switch positions may result in a stepwise increase in power output from the at least one heating element, accompanied by a corresponding stepwise increase in intensity of visible light radiation from the at least one heating element, particularly when such heating element comprises a lamp.

The invention is now described by way of example with reference to the accompanying drawings in which:

BRIEF DESCRIPTION OF THE DRAWINGS

FIG. 4 is a graph showing heater power as a function of switch position in respect of an embodiment of radiant electric heater arrangement according to the invention;

FIGS. 5A, 5B, 5C and 5D are top plan views of alternative forms of radiant electric heaters for use in place of the heater of FIG. 1 in the radiant electric heater arrangement of the invention.

DESCRIPTION OF PREFERRED EMBODIMENTS

Figure 1:
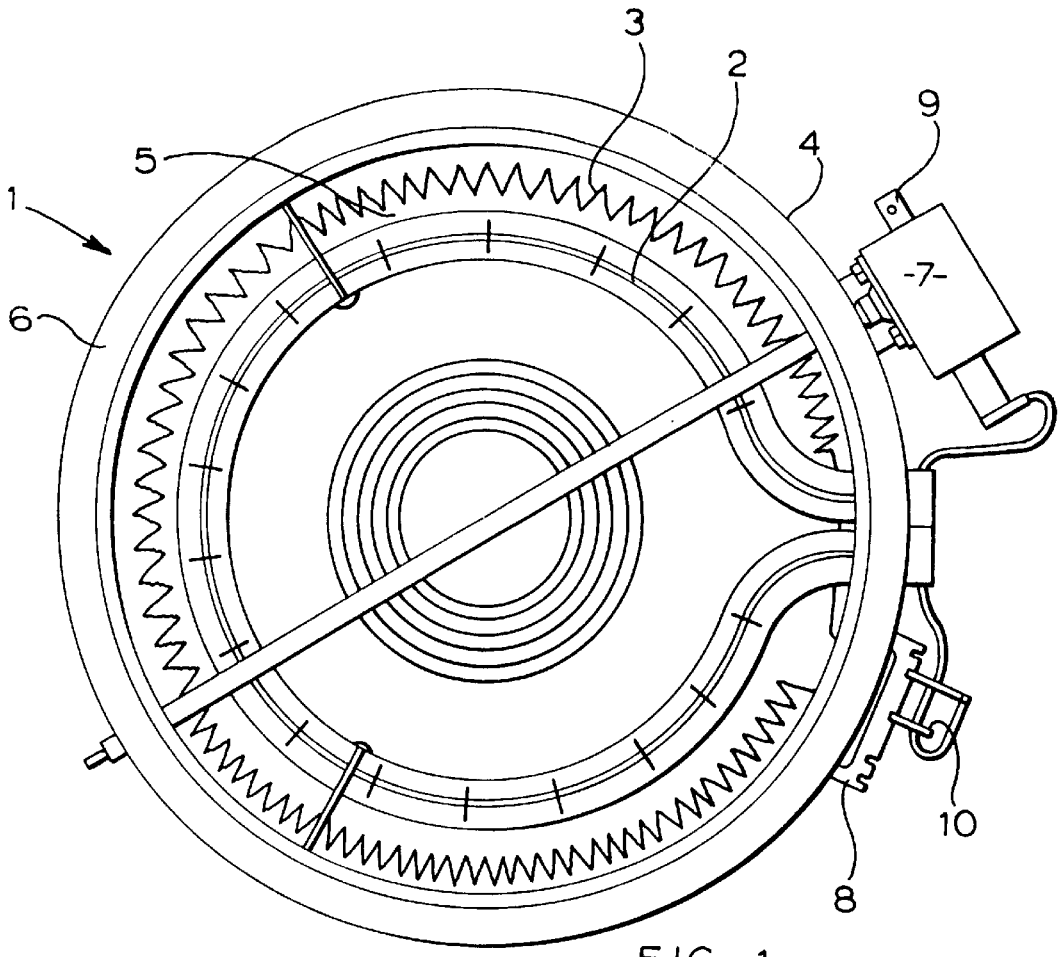
FIG. 1 is a top plan view of a radiant electric heater for use in a radiant electric heater arrangement of the invention.

Referring to FIG. 1, a radiant electric heater 1, for use with a glass-ceramic cooking appliance, comprises a circular lamp heating element 2, permanently connected in series with a ballast resistance element 3 in the form of a coiled bare wire heating element and supported inside a metal dish 4, of well-known construction, containing a base layer 5 of thermal and electrical insulation material, such as well-known microporous thermal and electrical insulation material. The lamp heating element 2 suitably comprises a tungsten filament supported in a tubular quartz enclosure containing a halogenated gas atmosphere. The two heating elements 2 and 3 are designed such that, for example, two thirds of the total combined power of the elements is produced in the lamp 2 and one third in the coiled wire element 3 when energised from a voltage supply. The heater is provided with a peripheral wall 6 of thermal insulation material and such that when the heater is located beneath a well-known form of glass-ceramic cook top (not shown), in a cooking appliance, the peripheral wall contacts the under side of the cook top.

A well-known form of temperature limiter 7 has a rod-like sensor which traverses the heater above the heating elements. The limiter 7 is arranged to interrupt the power supply to the heating elements at a predetermined temperature of the glass-ceramic cook top to prevent thermal damage to the cook top.

A terminal connector 8 is provided on the heater and the heater is arranged for connection to a power supply by means of terminals 9 and 10.

Figure 2:
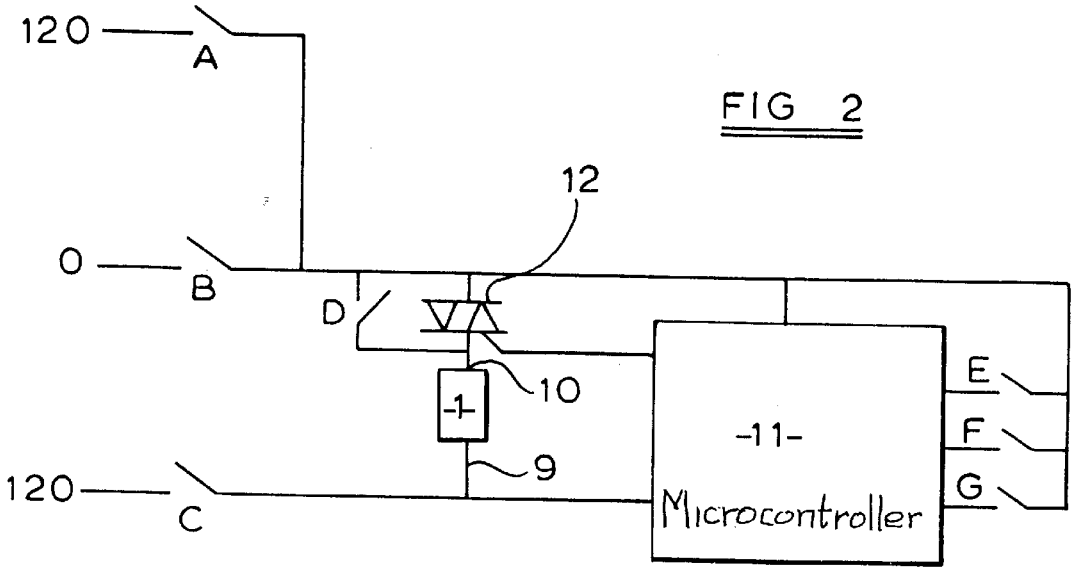
FIG. 2 is a circuit diagram of a radiant electric heater arrangement according to the invention.

Referring now to FIG. 2, the heater 1 of FIG. 1 is connected by way of a manually-operable ten-position switch, having seven sets of contacts A, B, C, D, E, F, G. a microprocessor-based control system (hereafter referred to as 'microcontroller') 11 and a triac 12, to a dual voltage alternating current supply arranged to provide 120 volts or 240 volts by selection. The ten position switch is suitably of well-known rotary form.

The arrangement is such that as the switch is operated from an off position through the ten consecutive discrete operating positions the power at the heater 1 increases incrementally up to a maximum in position ten. Such increase in power is visible to the user as a gradual stepwise increase in brightness of the heater lamp 2 (FIG. 1) as the switch is moved from one position to the next from the off position towards the highest position. This is achieved as hereafter described.

Table 1 shows which contacts of the ten position switch are closed for each user-selected position of the switch.

TABLE 1

| | A | B | C | D | E | F | G |
|---|---|---|---|---|---|---|---|
| 0 | | | | | | | |
| 1 | | X | X | | | | X |
| 2 | | X | X | | | X | |
| 3 | | X | X | | | X | X |
| 4 | | X | X | | X | | |
| 5 | | X | X | | X | | X |
| 6 | | X | X | X | X | X | |
| 7 | X | | X | | | X | X |
| 8 | X | | X | | X | | |
| 9 | X | | X | | X | | X |
| 10 | X | | X | X | X | X | |

X = contact closed

The arrangement is such that in switch positions 1 to 6, operation of the heater is by way of the 120 volts supply and in switch positions 7 to 10, operation is by way of the 240 volts supply. The microcontroller 11 operates in conjunction with the triac 12 in such a way that in increasing order from switch position 1 to switch position 6, a selectively increased proportion of half cycles in a predetermined number of half cycles of the 120 volts supply is applied to the heater 1. Furthermore, in increasing order from switch position 7 to switch position 10, a selectively increased proportion of half cycles in a predetermined number of half cycles of the 240 volts supply is applied to the heater 1.

Figure 3:
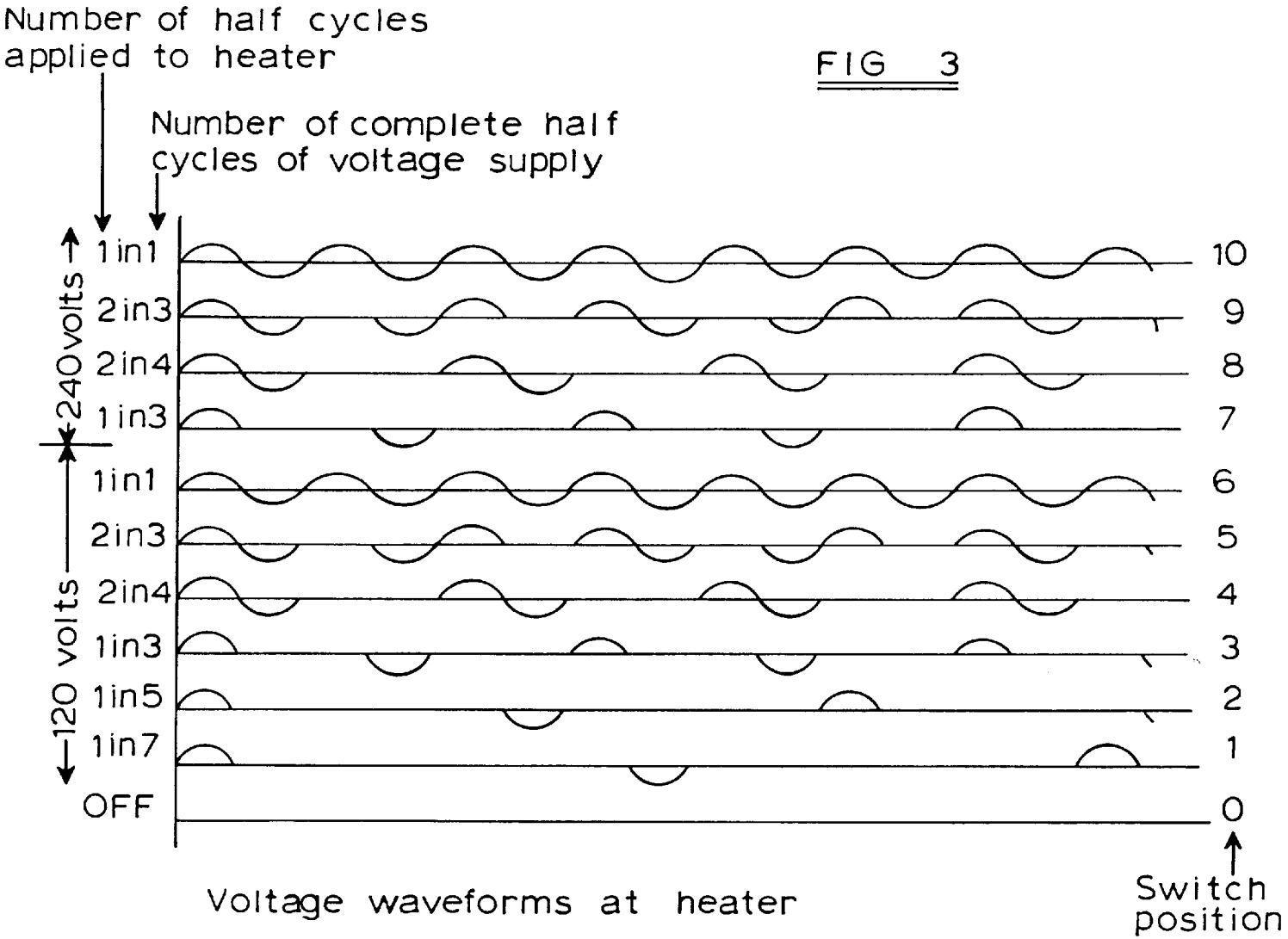
FIG. 3 is a diagrammatic representation of voltage waveforms applied to the radiant electric heater of FIG. 1 in the radiant electric heater arrangement of FIG. 2.

FIG. 3 shows the voltage waveforms at the heater 1 according to the switch position. Referring to Table 1 and FIG. 3, in switch position 1, contacts B, C and G are closed and one half cycle in every seven half cycles of the 120 volts supply is applied to the heater 1. Contacts C serve to isolate the heater 1 from the supply voltage in the off position. In switch position 2, contacts B, C and F are closed and one half cycle in every five half cycles of the 120 volts supply is applied to the heater 1. In switch position 3, contacts B, C, F and G are closed and one half cycle in every three half cycles of the 120 volts supply is applied to the heater 1. In switch position 4, contacts B, C and E are closed and two half cycles in every four half cycles of the 120 volts supply are applied to the heater 1. In switch position 5, contacts B, C, E and G are closed and two half cycles in every three half cycles of the 120 volts supply are applied to the heater 1. In switch position 6, contacts B, C, D, E and F are closed and the 120 volts supply in full and complete cyclic form is applied to the heater 1, the triac 12 being short-circuited by closure of the switch contacts D, thereby avoiding power dissipation of the triac in this switch position.

In switch positions 7 to 10, the power supply is changed from 120 volts to 240 volts by closure of switch contacts A instead of switch contacts B.

Accordingly, in switch position 7, contacts A, C, F and G are closed and one half cycle in every three half cycles of the 240 volts supply is applied to the heater 1. In switch position 8, contacts A, C and E are closed and two half cycles in every four half cycles of the 240 volts supply are applied to the heater 1. In switch position 9, contacts A, C, E and G are closed and two half cycles in every three half cycles of the 240 volts supply are applied to the heater 1.

In switch position 10, contacts A, C, D, E and F are closed and the 240 volts supply in full and complete cyclic form is applied to the heater 1, the triac 12 being short-circuited by closure of the switch contacts D, thereby avoiding power dissipation of the triac in this switch position.

With the resulting heater arrangement there is a smooth stepwise increase in power output and visible brightness of the heater as the switch is operated through its discrete operating positions up to position 10. The effect is illustrated in FIG. 4 which is a graphical plot of the heater power in watts against position of the switch, the heater being designed to dissipate 1800 watts at the full supply voltage of 240 volts.

In spite of the use of burst firing techniques, in which selected numbers of half cycles in chosen numbers of complete half cycles of the voltage supply are applied to the heater, there is no objectionable flicker from the heater lamp 2 in any of the switch positions. only in position 1 of the switch is there no visible illumination of the heater lamp 2, there being a distinct and different visible level of illumination in each of the remaining switch positions.

Instead of the ballast resistance element 3 comprising a coiled bare wire resistance element, it could comprise a known form of corrugated ribbon resistance element.

The ballast resistance element 3 may be able to be dispensed with where the inrush current on energising the lamp 2 is permitted and can be tolerated. Such a heater, containing only a lamp 2, is illustrated in FIG. 5A, this heater being otherwise the same as the heater of FIG. 1, previously described.

Figure 5B:
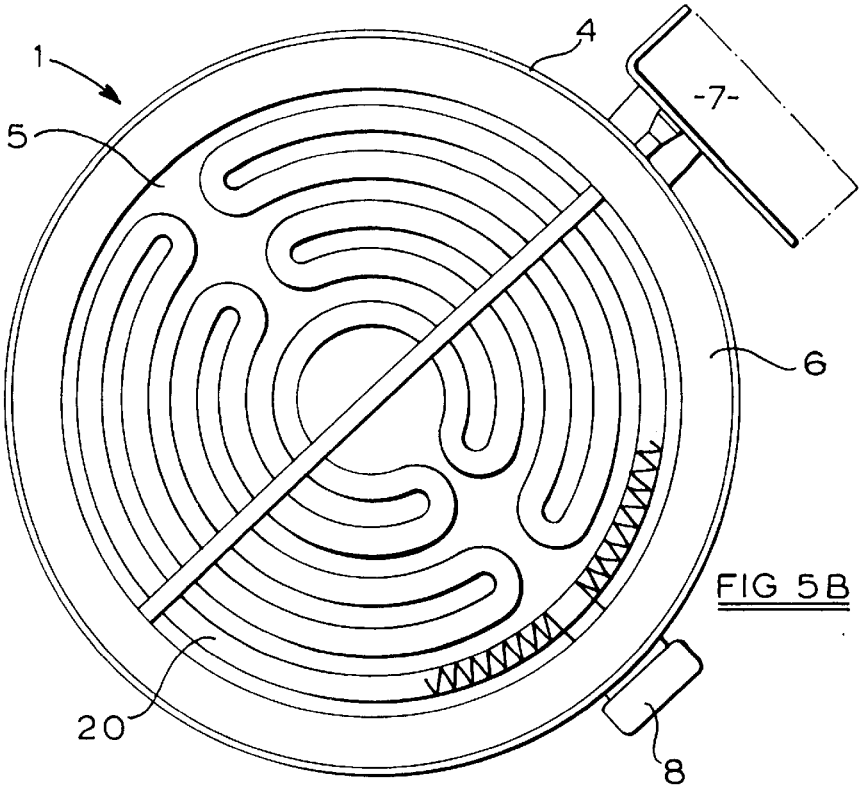

The invention is also applicable to heaters which do not employ a heating element in the form of a lamp. FIG. 5B illustrates a heater in which a heating element in the form of bare coiled resistance wire 20 is used in place of the lamp 2 of FIG. 5A.

Figure 5D:
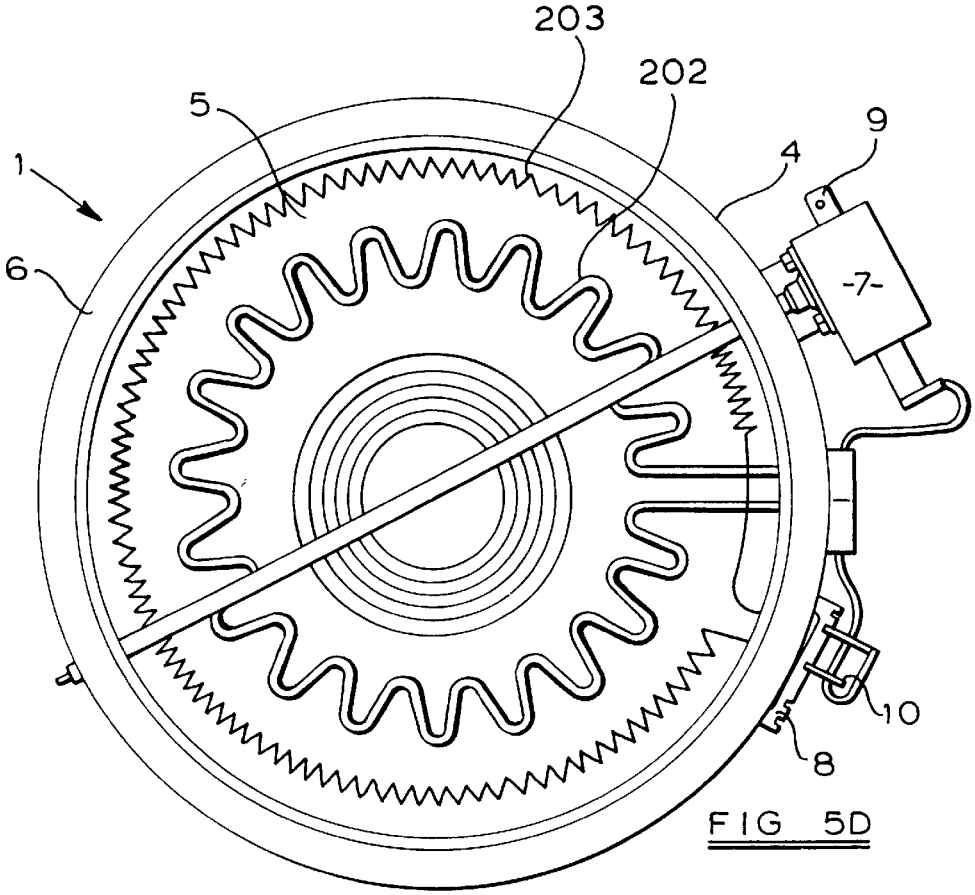
Figure 5C:
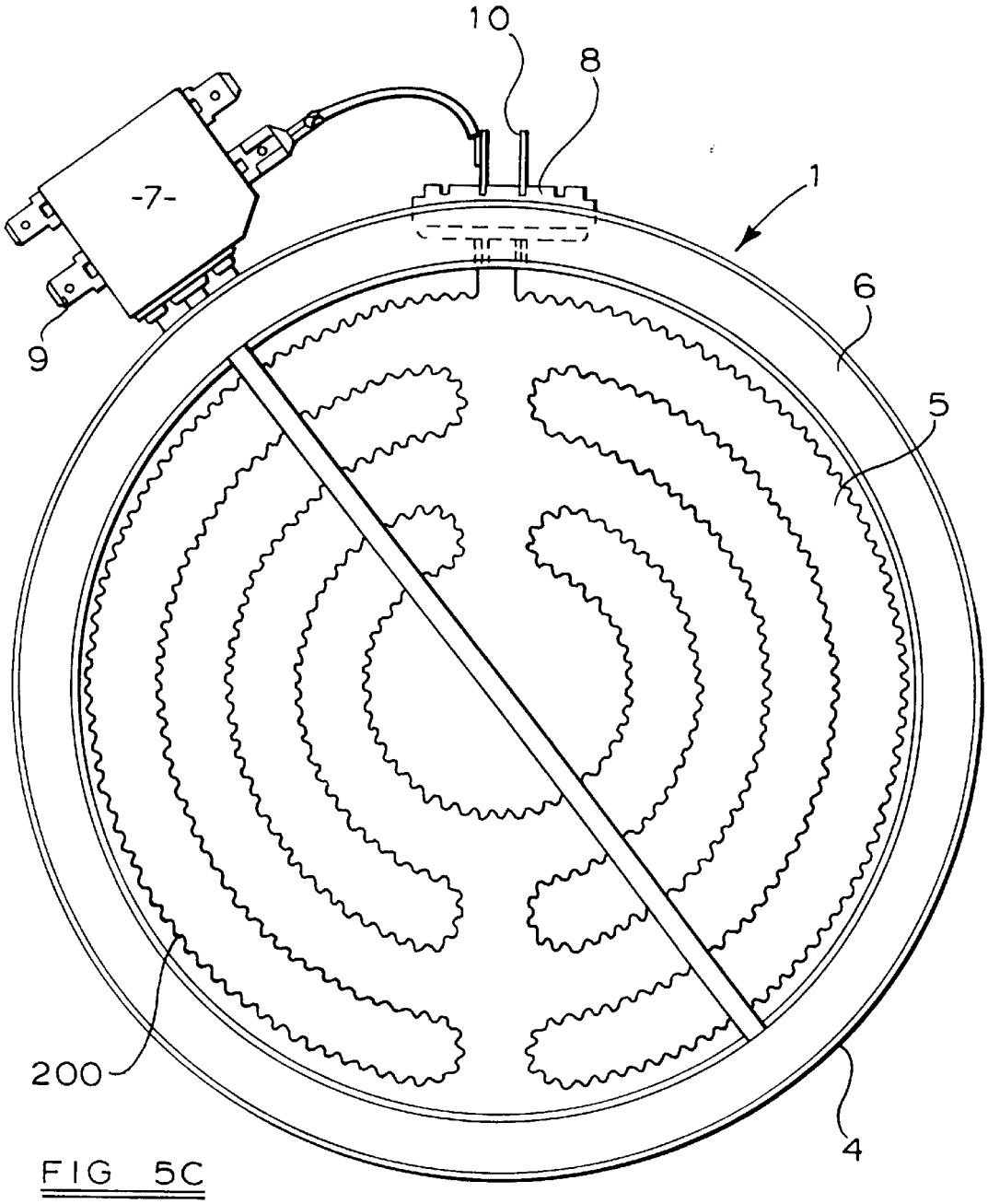

FIG. 5C illustrates a heater in which a heating element in the form of a known corrugated ribbon 200 of a metal alloy is used in place of the lamp 2 of FIG. 5A.

FIG. 5D illustrates a heater in which a heating element in the form of a known strip 202 of molybdenum disilicide material permanently connected in series with a bare coiled resistance wire 203 is used in place of the lamp 2 of FIG. 5A.

In some European countries a multi-phase alternating current supply voltage is available in which by connecting between one phase line and a neutral line a 230 volts supply is obtainable and by connecting between two phase lines a 400 volts supply is obtainable. The circuit arrangement of FIG. 2 and used with the heaters of FIGS. 1, 5A, 5B, 5C, 5D can be applied to such a voltage supply instead of the 120/240 volts supply. When used with a 230/400 volts supply, with switch contacts B and C closed and switch contacts A open, a supply voltage of 230 volts is obtained. With switch contacts A and C closed and switch contacts B open, a supply voltage of 400 volts is obtained.

In a particular embodiment, the ten position switch is arranged such that in positions 1 to 7, operation of the heater is by way of the 230 volts supply and in switch positions 8 to 10, operation is by way of the 400 volts supply.

Table 2 shows which contacts of the ten position switch are closed for each user-selected position of the switch.

TABLE 2

| | A | B | C | D | E | F | G |
|---|---|---|---|---|---|---|---|
| 0 | | | | | | | |
| 1 | | X | X | | | | |
| 2 | | X | X | | | | X |
| 3 | | X | X | | | X | |
| 4 | | X | X | | | X | X |
| 5 | | X | X | | X | | |
| 6 | | X | X | | X | X | |
| 7 | | X | X | X | X | X | X |
| 8 | X | | X | | X | | X |
| 9 | X | | X | | X | X | |
| 10 | X | | X | X | X | X | X |

X = contact closed

The microcontroller 11 is configured to operate with the triac 12 and the ten position switch as follows, for operation of the heater 1.

In switch position 1, contacts B and C are closed and one half cycle in every three half cycles of the 230 volts supply is applied cyclically to the heater 1 for 40 percent of a total cycle time period comprising a sequence of a predetermined number of half cycles and substantially no voltage is applied to the heater 1 during the remaining 60 percent of the total cycle time period of each sequence. Contacts C serve to isolate the heater 1 from the supply voltage in the off position.

In switch position 2, contacts B, C and G are closed and one half cycle in every three half cycles of the 230 volts supply is applied cyclically to the heater 1 for 55 percent of a total cycle time period comprising a sequence of a predetermined number of half cycles, substantially no voltage being applied to the heater 1 during the remaining 45 percent of the total cycle time period of each sequence.

In switch position 3, contacts B, C and F are closed and one half cycle in every three half cycles of the 230 volts supply is applied cyclically to the heater 1 for 75 percent of a total cycle time period comprising a sequence of a predetermined number of half cycles, substantially no voltage being applied to the heater 1 during the remaining 25 percent of the total cycle time period of each sequence.

In switch position 4, contacts B, C, F and G are closed and one half cycle in every three half cycles of the 230 volts supply is continuously applied to the heater 1.

In switch position 5, contacts B, C and E are closed and two half cycles in every three half cycles of the 230 volts supply are applied cyclically to the heater 1 for 40 percent of a total cycle time period. During the remaining 60 percent of each total cycle time period, one half cycle in every three half cycles of the 230 volts supply is applied to the heater 1.

In switch position 6, contacts B, C, E and F are closed and two half cycles in every three half cycles of the 230 volts supply are continuously applied to the heater 1.

In switch position 7, contacts B, C, D, E, F and G are closed and the 230 volts supply in full and complete cyclic form is applied to the heater 1.

In switch positions 8 to 10, the power supply voltage is changed from 230 volts to 400 volts by closure of switch contacts A instead of switch contacts B.

Accordingly, in switch position 8, contacts A, C, E and G are closed and two half cycles in every three half cycles of the 400 volts supply are applied cyclically to the heater 1 for 40 percent of a total cycle time period comprising a sequence of a predetermined number of half cycles. During the remaining 60 percent of each total cycle time period (i.e. each sequence), one half cycle in every three half cycles of the 400 volts supply is applied to the heater 1.

In switch position 9, contacts A, C, E and F are closed and two half cycles in every three half cycles of the 400 volts supply are continuously applied to the heater 1.

In switch position 10, contacts A, C, D, E, F and G are closed and the 400 volts supply in full and complete cyclic form is applied to the heater 1.

In switch positions 7 and 10, the closure of contacts D results in short-circuiting of the triac 12, to avoid power dissipation of the triac in these switch positions.

With the resulting heater arrangement, there is a smooth stepwise increase in power output and visible brightness of the heater 1 as the switch is operated through its discrete operating positions up to position 10. For the heater of FIG. 1, in which two thirds of the total combined power of the heating elements 2 and 3 is produced in the lamp 2 and one third in the coiled wire element 3 when energised, the percentage of full power output for the heater in each of the ten switch positions, when operating from the 230/400 volts supply is approximately as follows:

| Switch Position | Percent Of Full Heater Power |
|---|---|
| 1 | 6 |
| 2 | 8 |
| 3 | 11 |
| 4 | 16 |
| 5 | 21 |
| 6 | 28 |
| 7 | 40 |
| 8 | 53 |
| 9 | 71 |
| 10 | 100 |

The heater arrangement of the invention for 230/400 volts operation is particularly advantageous in that since the switching element is a triac, with no moving contacts to wear out, and since changes in current between discrete power levels are small, a much faster switching rate (typically ten times faster) than with conventional electromechanical energy regulators hitherto used, can be employed without infringing strict European switching regulations with respect to causing disturbances on mains voltage supplies.

I claim:

1. A radiant electric heater arrangement for connection to a dual voltage supply which provides a first alternating current supply voltage and a second alternating current supply voltage higher than the first, the arrangement comprising:

a heater having at least one heating element;

a manually operable multiple discrete position switch means for manually selecting in sequence a predetermined number of discrete different power settings for the at least one heating element from the voltage supply;

control means co-operating between the switch means and the supply whereby in each position of a first sequential series of discrete positions of the switch means the at least one heating element is selectively energisable from the first supply voltage in such a way that at least one selected proportion of half cycles in a predetermined number of half cycles of the first supply voltage is or are arranged for application to the at least one heating element;

and further whereby in each position of a second sequential series of discrete positions of the switch means, following the first sequential series, the at least one heating element is selectively energisable from the second supply voltage in such a way that at least one selected proportion of half cycles in a predetermined number of half cycles of the second supply voltage is arranged for application to the at least one heating element; the arrangement being such that a stepwise increase in power output from the heater is obtainable in operation from one position of the switch means to the next through the first and second sequential series of switch positions.

2. A heater arrangement according to claim 1, wherein the at least one heating element comprises one or more elements selected from: coiled bare resistance wire; metal ribbon; infra-red lamp(s); molybdenum disilicide wire or strip.

3. A heater arrangement according to claim 2, wherein the metal ribbon is of corrugated form.

4. A heater arrangement according to claim 2, characterised in that the or each infra-red lamp comprises a tungsten filament inside an envelope containing a halogenated atmosphere.

5. A heater arrangement according to claim 2, wherein the at least one heating element is selected from an infra-red lamp and a molybdenum disilicide wire or strip, each of which is permanently connected in series with a second heating element.

6. A heater arrangement according to claim 5, wherein the second heating element is selected from coiled bare resistance wire and metal ribbon form.

7. A heater arrangement according to claim 5, wherein the second heating element serves as a ballast resistor to damp inrush current in the at least one lamp or molybdenum disilicide heating element.

8. A heater arrangement according to claim 1, wherein the dual voltage supply comprises an alternating current supply having at least two phases and in which the first alternating current supply voltage is obtained by connecting to a line for one supply phase and a neutral line and the second alternating current supply voltage is obtained by connecting to lines for two supply phases.

9. A heater arrangement according to claim 1, wherein in the first sequential series of discrete positions of the switch means the at least one heating element is selectively energisable from the first supply voltage in such a way that from one switch position to the next a selectively increased proportion of half cycles in a predetermined number of half cycles of the first supply voltage is arranged for application to the at least one heating element and in the second sequential series of discrete positions of the switch means, following the first sequential series, the at least one heating element is selectively energisable from the second supply voltage in such a way that from one switch position to the next in the second sequential series a selectively increased proportion of half cycles in a predetermined number of half cycles of the second supply voltage is arranged for application to the at least one heating element.

10. A heater arrangement according to claim 9, wherein a switch means having ten positions is provided; a first alternating current supply voltage of substantially 120 volts and a second alternating current supply voltage of substantially 240 volts is arranged and in a first sequential series of six discrete positions the at least one heating element is selectively energisable from the first supply voltage such that:

a) in the first position, one half cycle in every seven half cycles of the first supply voltage is arranged for application to the at least one heating element;

b) in the second position, one half cycle in every five half cycles of the first supply voltage is arranged for application to the at least one heating element;

c) in the third position, one half cycle in every three half cycles of the first supply voltage is arranged for application to the at least one heating element;

d) in the fourth position, two half cycles in every four half cycles of the first supply voltage are arranged for application to the at least one heating element;

e) in the fifth position, two half cycles in every three half cycles of the first supply voltage are arranged for application to the at least one heating element;

f) in the sixth position, the first supply voltage in full and complete cyclic form is arranged for application to the at least one heating element;

and in a second sequential series of four discrete positions, following on from the first series and comprising positions seven to ten of the switch means, the at least one heating element is selectively energisable from the second supply voltage such that:

i) in the seventh position, one half cycle in every three half cycles of the second supply voltage is arranged for application to the at least one heating element;

ii) in the eighth position, two half cycles in every four half cycles of the second supply voltage are arranged for application to the at least one heating element;

iii) in the ninth position, two half cycles in every three half cycles of the second supply voltage are arranged for application to the at least one heating element;

iv) in the tenth position, the second supply voltage in full and complete cyclic form is arranged for application to the at least one heating element.

11. A heater arrangement according to claim 1, wherein in one or more positions of the switch means each sequence of a predetermined number of half cycles of the first or second supply voltage is separated into first and second proportions, the second proportion being different from the first proportion, with the first and second proportions following each other cyclically in sequence and each in predetermined ratio of total number of half cycles in each sequence.

12. A heater arrangement according to claim 11, wherein only the first or the second selected proportion of half cycles in each sequence results in the application of the supply voltage to the at least one heating element.

13. A heater arrangement according to claim 12, characterised in that a switch means having ten positions is provided; a first alternating current supply voltage of substantially 230 volts and a second alternating current supply voltage of substantially 400 volts is arranged and in a first sequential series of seven discrete switch positions the at least one heating element is selectively energisable from the first supply voltage such that:

a) in the first position, one half cycle in every three half cycles of the first supply voltage is arranged for application cyclically to the at least one heating element for about 40 percent of a sequence of a predetermined number of half cycles, substantially no supply voltage being arranged to be applied to the at least one heating element during the remaining about 60 percent of each sequence;

b) in the second position, one half cycle in every three half cycles of the first supply voltage is arranged for application cyclically to the at least one heating element for about 55 percent of a sequence of a predetermined number of half cycles, substantially no supply voltage being arranged to be applied to the at least one heating element during the remaining about 45 percent of each sequence;

c) in the third position, one half cycle in every three half cycles of the first supply voltage is arranged for application cyclically to the at least one heating element for about 75 percent of a sequence of a predetermined number of half cycles, substantially no supply voltage being arranged to be applied to the at least one heating element during the remaining about 25 percent of each sequence;

d) in the fourth position, one half cycle in every three half cycles of the first supply voltage is arranged for continuous application to the at least one heating element;

e) in the fifth position, two half cycles in every three half cycles of the first supply voltage are arranged for application cyclically to the at least one heating element for about 40 percent of a sequence of a predetermined number of half cycles and one half cycle in every three half cycles of the first supply voltage is arranged for application to the at least one heating element during the remaining about 60 percent of each sequence;

f) in the sixth position, two half cycles in every three half cycles of the first supply voltage are arranged for continuous application to the at least one heating element;

g) in the seventh position, the first supply voltage in full and complete cyclic form is arranged for application to the at least one heating element:

and in a second sequential series of three discrete positions, following on from the first series and comprising positions eight to ten of the switch means, the at least one heating element is selectively energisable from the second supply voltage such that:

i) in the eighth position, two half cycles in every three half cycles of the second supply voltage are arranged for application cyclically to the at least one heating element for about 40 percent of a sequence of a predetermined number of half cycles and one half cycle in every three half cycles of the second supply voltage is arranged for application to the at least one heating element during the remaining about 60 percent of each sequence;

ii) in the ninth position, two half cycles in every three half cycles of the second supply voltage are arranged for continuous application to the at least one heating element;

iii) in the tenth position, the second supply voltage in full and complete cyclic form is arranged for application to the at least one heating element.

14. A heater arrangement according to claim 1, wherein the control means comprises a microprocessor-based control system.

15. A heater arrangement according to claim 14, wherein the control system is in association with a triac switching element.

16. A heater arrangement according to claim 1, wherein sequential selection of the switch positions results in a stepwise increase in power output from the at least one heating element, accompanied by a corresponding stepwise increase in intensity of visible light radiation from the at least one heating element.

17. A heater arrangement according to claim 16, wherein the at least one heating element comprises a lamp.

18. A radiant electric heater arrangement for connection to a dual voltage supply which provides a first alternating current supply voltage of substantially 120 volts and a second alternating current supply voltage of substantially 240 volts, the arrangement comprising:

a heater having at least one heating element;

a manually operable multiple discrete position switch means for manually selecting in sequence ten discrete different power settings for the at least one heating element from the voltage supply;

control means co-operating between the switch means and the supply whereby in each position of a first sequential series of six discrete positions of the switch means the at least one heating element is selectively energisable from the first supply voltage in such a way that:

a) in the first position, one half cycle in every seven half cycles of the first supply voltage is arranged for application to the at least one heating element;

b) in the second position, one half cycle in every five half cycles of the first supply voltage is arranged for application to the at least one heating element;

c) in the third position, one half cycle in every three half cycles of the first supply voltage is arranged for application to the at least one heating element;

d) in the fourth position, two half cycles in every four half cycles of the first supply voltage are arranged for application to the at least one heating element;

e) in the fifth position, two half cycles in every three half cycles of the first supply voltage are arranged for application to the at least one heating element;

f) in the sixth position, the first supply voltage in full and complete cyclic form is arranged for application to the at least one heating element;

and in a second sequential series of four discrete positions of the switch means, following on from the first sequential series and comprising positions seven to ten of the switch means, the at least one heating element is selectively energisable from the second supply voltage such that:

i) in the seventh position, one half cycle in every three half cycles of the second supply voltage is arranged for application to the at least one heating element;

ii) in the eighth position, two half cycles in every four half cycles of the second supply voltage are arranged for application to the at least one heating element;

(iii) in the ninth position, two half cycles in every three half cycles of the second supply voltage are arranged for application to the at least one heating element; and (iv) in the tenth position, the second supply voltage in full and complete cyclic form is arranged for application to the at least one heating element.

19. A radiant electric heater arrangement for connection to a dual voltage supply which provides a first alternating current supply voltage of substantially 230 volts and a second alternating current supply voltage of substantially 400 volts, the arrangement comprising:

a heater having at least one heating element;

a manually operable multiple discrete position switch means for manually selecting in sequence ten discrete different power settings for the at least one heating element from the voltage supply;

control means co-operating between the switch means and the supply whereby in each position of a first sequential series of seven discrete positions of the switch means the at least one heating element is selectively energisable from the first supply voltage such that:

a) in the first position, one half cycle in every three half cycles of the first supply voltage is arranged for application cyclically to the at least one heating element for about 40 percent of a sequence of a predetermined number of half cycles, substantially no supply voltage being arranged to be applied to the at least one heating element during the remaining about 60 percent of each sequence;

b) in the second position, one half cycle in every three half cycles of the first supply voltage is arranged for application cyclically to the at least one heating element for about 55 percent of a sequence of a predetermined number of half cycles, substantially no supply voltage being arranged to be applied to the at least one heating element during the remaining about 45 percent of each sequence;

c) in the third position, one half cycle in every three half cycles of the first supply voltage is arranged for application cyclically to the at least one heating element for about 75 percent of a sequence of a predetermined number of half cycles, substantially no supply voltage being arranged to be applied to the at least one heating element during the remaining about 25 percent of each sequence;

d) in the fourth position, one half cycle in every three half cycles of the first supply voltage is arranged for continuous application to the at least one heating element;

e) in the fifth position, two half cycles in every three half cycles of the first supply voltage are arranged for application cyclically to the at least one heating element for about 40 percent of a sequence of a predetermined number of half cycles, and one half cycle in every three half cycles of the first supply voltage is arranged for application to the at least one heating element during the remaining about 60 percent of each sequence;

f) in the sixth position, two half cycles in every three half cycles of the first supply voltage are arranged for continuous application to the at least one heating element;

g) in the seventh position, the first supply voltage in full and complete cyclic form is arranged for application to the at least one heating element;

and in a second sequential series of three discrete positions of the switch means, following on from the first sequential series and comprising positions eight to ten of the switch means, the at least one heating element is selectively energisable from the second supply voltage such that:

i) in the eighth position, two half cycles in every three half cycles of the second supply voltage are arranged for application cyclically to the at least one heating element for about 40 percent of a sequence of a predetermined number of half cycles and one half cycle in every three half cycles of the second supply voltage is arranged for application to the at least one heating element during the remaining about 60 percent of each sequence;

ii) in the ninth position, two half cycles in every three half cycles of the second supply voltage are arranged for continuous application to the at least one heating element; and iii) in the tenth position, the second supply voltage in full and complete cyclic form is arranged for application to the at least one heating element.

20. A heater arrangement according to claim 19, wherein the control system is in association with a triac switching element.

* * * * *